US008869932B2

(12) United States Patent
Butler et al.

(10) Patent No.: US 8,869,932 B2
(45) Date of Patent: Oct. 28, 2014

(54) CROSSOVER MUFFLER

(71) Applicants: Boyd L. Butler, Cottonwood Heights, UT (US); Trent V. Bray, Sandy, UT (US)

(72) Inventors: Boyd L. Butler, Cottonwood Heights, UT (US); Trent V. Bray, Sandy, UT (US)

( * ) Notice: Subject to any disclaimer, the term of this patent is extended or adjusted under 35 U.S.C. 154(b) by 30 days.

(21) Appl. No.: 13/720,696

(22) Filed: Dec. 19, 2012

(65) Prior Publication Data

US 2014/0166393 A1 Jun. 19, 2014

(51) Int. Cl.
*F01N 13/08* (2010.01)
*F01N 13/18* (2010.01)

(52) U.S. Cl.
CPC ..... *F01N 13/08* (2013.01); *F01N 13/1805* (2013.01)
USPC ..... 181/238; 181/228; 181/239

(58) Field of Classification Search
USPC ..... 181/227, 228, 238, 239, 240
See application file for complete search history.

(56) References Cited

U.S. PATENT DOCUMENTS 4,953,352 A 9/1990 Campbell
5,824,972 A 10/1998 Butler
6,283,162 B1 9/2001 Butler
6,341,664 B1 1/2002 Gerber
6,460,248 B2 10/2002 Butler
6,478,340 B1 11/2002 Butler
6,662,900 B2 12/2003 Cathcart et al.
6,889,499 B2 5/2005 Bassani
7,426,980 B2 9/2008 Bassani

OTHER PUBLICATIONS

Dynomax: Mufflers: Ultra Flo X; htpp://www.dynomsx.com/products/ultraflox.html; accessed Mar. 31, 2009; 6 pages.
Xlerator Performance Exhaust; Stainless Steel High Performance Mufflers; © 2004 Goerlich's Inc.; 6 pages.

*Primary Examiner* — Jeremy Luks
(74) *Attorney, Agent, or Firm* — Thorpe North & Western LLP

(57) ABSTRACT

A performance-enhancing crossover muffler for internal combustion engines includes an enclosed case having an inside, and two inlet pipes located inside the case having respective inlet ends extending through a frontside of the case for connection with two outside engine exhaust manifolds, and respective interior ends which merge together to define a merge entry. The muffler also includes one or more outlet pipes located inside the case with outlet end extending through a backside of the case for connection with an outside tailpipe, an interior end defining a merge exit, and one or more apertures in the outlet pipe communicating with the inside of the case. The muffler further includes a piping merge zone between the merge entry and the merge exit for commingling exhaust flows from the two engine exhaust manifolds. The two inlet pipes and the piping merge zone are without communication with the inside of the case.

23 Claims, 11 Drawing Sheets

CROSSOVER MUFFLER

FIELD OF THE INVENTION

The present invention relates generally to exhaust systems and mufflers, and more specifically to vehicle exhaust systems and mufflers having an internal crossover configuration.

BACKGROUND OF THE INVENTION AND RELATED ART

It is known that the performance of an automobile engine can be increased in many instances by providing a crossover connection between the exhaust pipes in the automobile's exhaust system to balance the instantaneous pressure between the two branches of the exhaust system. Consequently, various configurations of crossover pipes extending between two exhaust pipes have been developed and used, such as a length of pipe extending between exhaust pipes to form an H-Pipe exhaust assembly. A similar connection can be formed by bending the exhaust pipes so that the exhaust pipes come together for a short distance in side-by-side relationship and then separate again. A hole is cut in the side of each of the two pipes where they come together and the pipes are joined, such as by welding around the mating holes, so that the interiors of the two pipes communicate through the hole. This type of connection is commonly called an X-Pipe connection since the pipes generally form an X shape where they come together. A connection where multiple exhaust pipes are connected to one end of a chamber or collector and two tailpipes are connected to the opposite end of the chamber or collector is shown in U.S. Pat. No. 4,953,342. These various cross flow regions described between the secondary exhaust pipes are designed to allow fluid communication or cross flow of the exhaust gasses from each of the headers of the engine prior to entering the tailpipes. Such cross flow communication is desirable for reducing peak pressures and the build up of exhaust gasses leading to excessive back pressure, and to allow for the more efficient discharge of exhaust gases. These arrangements can be used with one or two tailpipes as shown in U.S. Pat. Nos. 6,283,162 and 6,360,238. Further, similar results can be achieved when combining the exhaust flow from two exhaust pipes into a single exhaust or tailpipe to form a Y-Pipe exhaust assembly. U.S. Pat. No. 6,478,330 shows two exhaust pipes with beveled outlet portions affixed together along a respective edge of each thereof so as to merge together, with respective centerlines at an oblique angle, into a single outlet opening which is connectable to the inlet of a tailpipe.

Attempts have been made to combine the effects of the crossover exhaust systems with mufflers, wherein with the exhaust pipe crossover is located within a case which serves as a muffler. For example, the Dynomax Ultra Flo X muffler from Tenneco Automotive Operating Company Inc. of Lake Forest, Ill., has two exhaust pipes entering one end of a muffler case which come together in the center of the muffler case in an X-Pipe configuration and then extend out the opposite end of the muffler case. The exhaust pipes are perforated along their entire lengths within the muffler case and the muffler case includes packing, such as fiber glass packing, to provide noise absorption. Goerlich's, Inc. dba XLerator Performance Exhaust of Goldsboro, N.C., sells an X Muffler which includes an X manifold within a muffler case with two exhaust pipes entering one end of the manifold through one end of the muffler case and two exhaust pipes leaving the other end through the opposite end of the muffler case. The X manifold within the muffler case brings the exhaust from each exhaust pipe together in the center of the manifold as in the X-Pipe configuration. Again, the X manifold is perforated around both the inlet end and the outlet end to allow exhaust gas flow into the muffler case throughout its entire length. U.S. Pat. Nos. 6,589,499 and 7,326,950 show similar mufflers. All of these mufflers claim to provide the performance advantages of an X-Pipe exhaust crossover while at the same time providing a muffler for exhaust noise reduction. However, the Inventors of the performance-enhancing crossover muffler described herein have found that these types of mufflers do not provide the same level of performance increase that is provided by an optimized crossover exhaust system.

SUMMARY OF THE INVENTION

In accordance with one representative embodiment described herein, a performance-enhancing crossover muffler is provided for increasing engine performance while attenuating acoustic noise in an exhaust flow. The crossover muffler includes an enclosed case having an inside, and two inlet pipes located inside the case having respective inlet ends extending through a frontside of the case that are adapted for connection with two outside engine manifold exhaust pipes, along with respective interior ends opposite the inlet ends which merge together to define a merge entry. The crossover muffler also includes one or more outlet pipes located inside the case which comprise an outlet end extending through a backside of the case that is adapted for connection with an outside tailpipe, an interior end opposite the outlet end defining a merge exit, and one or more apertures in the outlet pipe communicating with the inside of the case. The crossover muffler further includes a piping merge zone between the merge entry and the merge exit for commingling exhaust flows from the two engine manifold exhaust pipes. The two inlet pipes and the piping merge zone are without communication with the inside of the case.

In accordance with another representative embodiment described herein, a performance-enhancing crossover muffler is provided for internal combustion engines. The crossover muffler includes an enclosed case having an inside and two inlet pipes located inside the case that comprise respective inlet ends extending through a frontside of the case that are adapted for connection with two outside engine manifold exhaust pipes, and respective interior ends opposite the inlet ends merging together to define a merge entry. The muffler also includes a single outlet pipe located inside the case which comprises an outlet end extending through a backside of the case that is adapted for connection with an outside tailpipe, an interior end opposite the outlet end defining a merge zone exit, and a plurality of apertures in the outlet pipe communicating with the inside of the case. The muffler further includes a piping merge zone between the merge entry and the merge exit for combining exhaust flows from the engine manifold exhaust pipes. The two inlet pipes and the piping merge zone are without communication with the inside of the case.

In accordance with yet another representative embodiment described herein, a performance-enhancing crossover muffler is provided for internal combustion engines. The crossover muffler includes an enclosed case having an inside and two pipes located inside the case that comprise respective inlet sections extending through a frontside of the case that are adapted for connection with two outside engine manifold exhaust pipes, respective outlet sections extending through a backside of the case that are adapted for connection with two outside tailpipes, and respective mid-span sections coupled together to form a piping merge zone for commingling the exhaust flows from the engine manifold exhaust pipes. Both outlet sections include a plurality of apertures communicating with the inside of the case, while both inlet sections and the piping merge zone are without communication with the inside of the case.

In accordance with another representative embodiment described herein, a method is provided for attenuating acoustic noise in a vehicular exhaust flow. The method includes directing a pair of exhaust flows through an exhaust piping assembly inside an enclosed muffler case, with the exhaust piping assembly comprising a set of dual inlet pipes with inlet ends extending through a frontside of the case that are adapted for connection with two outside engine manifold exhaust pipes, and with interior ends of the inlet pipes opposite the inlet ends merging together to define a merge entry. The method also includes commingling the exhaust flows during passage through a merge zone between the merge entry and a merge exit while isolating the exhaust flows from the inside of the case during passage through the inlet pipes and merge zone. The method further includes communicating the exhaust flows with the inside of the case during passage through one or more outlet pipes having interior ends defining the merge exit and outlet ends extending through a backside of the case and adapted for connection with one ore more outside tailpipes.

In accordance with yet another representative embodiment described herein, a method is provided for making a performance-enhancing muffler for internal combustion engines. The method includes assembling an exhaust piping assembly comprising two inlet pipes having inlet ends adapted for connection with two outside engine manifold exhaust pipes and interior ends opposite the inlet ends merging together to define a merge entry, an outlet pipe having an outlet end adapted for connection with an outside tailpipe, an interior end opposite the outlet end defining a merge exit, and one or more apertures communicating with an outside of the outlet pipe, and a piping merge zone between the merge entry and the merge exit for commingling exhaust flows from the two manifold exhaust pipes. The method also includes installing the exhaust piping assembly into an enclosed case with the inlet pipes extending through a frontside of the case and the outlet pipe extending through a backside of the case, and wherein the two inlet pipes and the piping merge zone are without communication with the inside of the case and the outlet pipe is in communication with the inside of the case through one or more apertures.

In accordance with yet another representative embodiment described herein, a method is provided for making a performance-enhancing muffler for internal combustion engines. The method includes assembling two pipes into an exhaust piping assembly comprising dual inlet sections having inlet ends adapted for connection with two engine manifold exhaust pipes, dual outlet sections having outlet ends adapted for connection with two tailpipes, dual mid-span sections coupled together to form a piping merge zone for commingling the exhaust flows from the engine manifold exhaust pipes, and a plurality of apertures through the sidewalls of both outlet sections communicating with an outside of the pipes. The method also includes installing the exhaust piping assembly into an enclosed case with the inlet pipes extending through a frontside of the case and the outlet pipe extending through a backside of the case, wherein both inlet sections and the piping merge zone are without communication with the inside of the case while both outlet sections communicate with the inside of the case through the plurality of apertures.

BRIEF DESCRIPTION OF THE DRAWINGS

Features and advantages of the present invention will be apparent from the detailed description that follows, and when taken in conjunction with the accompanying drawings together illustrate, by way of example, features of the invention. It will be readily appreciated that these drawings merely depict representative embodiments of the present invention and are not to be considered limiting of its scope, and that the components of the invention, as generally described and illustrated in the figures herein, could be arranged and designed in a variety of different configurations. Nonetheless, the present invention will be described and explained with additional specificity and detail through the use of the accompanying drawings, in which.

DETAILED DESCRIPTION OF EXEMPLARY EMBODIMENTS

Figure 1:
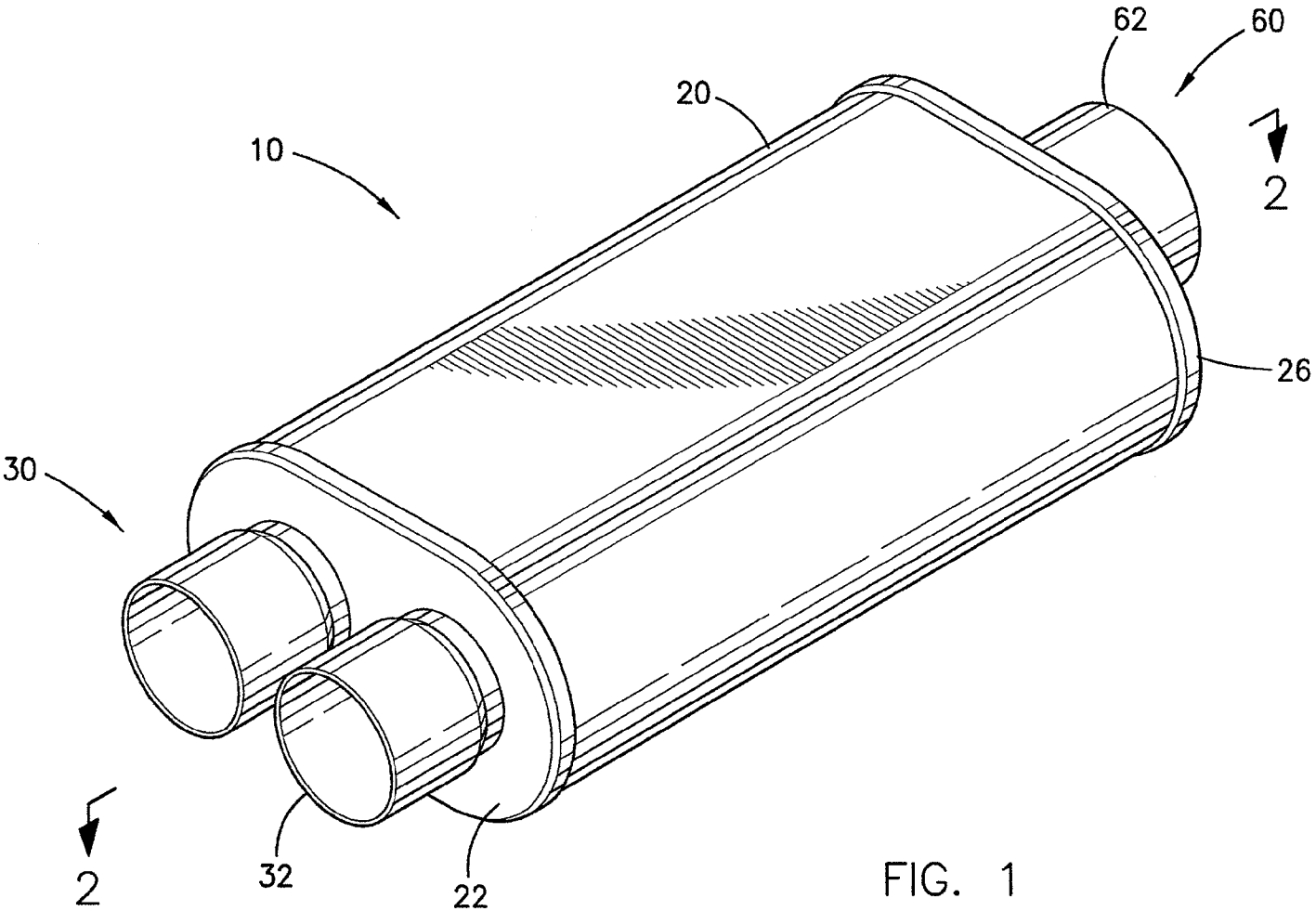
FIG. 1 is an exterior perspective view of a crossover muffler, in accordance with one representative embodiment.

The following detailed description makes reference to the accompanying drawings, which form a part thereof and in which are shown, by way of illustration, various representative embodiments in which the invention can be practiced. While these embodiments are described in sufficient detail to enable those skilled in the art to practice the invention, it should be understood that other embodiments can be realized and that various changes can be made without departing from the spirit and scope of the present invention. As such, the following detailed description is not intended to limit the scope of the invention as it is claimed, but rather is presented for purposes of illustration, to describe the features and characteristics of the representative embodiments, and to sufficiently enable one skilled in the art to practice the invention. Accordingly, the scope of the present invention is to be defined solely by the appended claims.

Furthermore, the following detailed description and representative embodiments of the invention will best be understood with reference to the accompanying drawings, wherein the elements and features of the embodiments are designated by numerals throughout.

Definitions

In describing and claiming the present invention, the following terminology will be used.

The singular forms "a," "an," and "the" include plural references unless the context clearly dictates otherwise. Thus, for example, reference to "a pipe" includes reference to one or more of such structures, "a sound-dampening material" includes reference to one or more of such materials, and "an assembly step" refers to one or more of such steps.

As used herein, "inside" refers to the volume inside an enclosed structure such as a muffler case or pipe;

As used herein, "interior" refers to inside or within the boundary of an enclosed structure, as opposed to "outside" the enclosed structure;

As used herein, "radial" refers to a direction that is substantially perpendicular to the longitudinal axis of an object such as a pipe, or to the passageway or axial direction of fluid flow passing therein;

As used herein, "longitudinal" refers to a direction that is substantially parallel to the longitudinal axis or passageway of an object such as a pipe;

As used herein, "coaxial" refers to the longitudinal center axes of two or more rounded or tubular bodies lying substantially along the same line;

As used herein, "choke" refers to a longitudinal location with the smallest cross-sectional area along a piping system comprising two merging pipes, and not necessarily the longitudinal location wherein a gaseous flow traveling therein is the most restricted;

As used herein, "substantial" when used in reference to a quantity or amount of a material, or a specific characteristic thereof, refers to an amount that is sufficient to provide an effect that the material or characteristic was intended to provide. The exact degree of deviation allowable may in some cases depend on the specific context. Similarly, "substantially free of" or the like refers to the lack of an identified element or agent in a composition. Particularly, elements that are identified as being "substantially free of" are either completely absent from the composition, or are included only in amounts which are small enough so as to have no measurable effect on the composition.

As used herein, "about" refers to a degree of deviation based on experimental error typical for the particular property identified. The latitude provided by the term "about" will depend on the specific context and particular property and can be readily discerned by those skilled in the art. The term "about" is not intended to either expand or limit the degree of equivalents which may otherwise be afforded a particular value. Further, unless otherwise stated, the term "about" shall expressly include "exactly," consistent with the discussion below regarding ranges and numerical data.

Concentrations, dimensions, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a range of about 1 to about 200 should be interpreted to include not only the explicitly recited limits of 1 and about 200, but also to include individual sizes such as 2, 3, 4, and sub-ranges such as 10 to 50, 20 to 100, etc.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Embodiments of the Invention

Illustrated in FIGS. 1-21 are several exemplary embodiments of a performance-enhancing crossover muffler for internal combustion engines, which embodiments also include various methods for attenuating acoustic noise in a vehicular exhaust flow and for making a performance-enhancing crossover muffler. As described herein, the crossover muffler described provides several significant advantages and benefits over other types of mufflers and methods for reducing or attenuating the acoustic noise generated by an internal combustion engine. However, the recited advantages are not meant to be limiting in any way, as one skilled in the art will appreciate that other advantages may also be realized upon practicing the present invention.

FIG. 1 shows the exterior of one representative embodiment 10 of the crossover muffler which includes an enclosed muffler case 20 having two inlet pipes 30 with inlet ends 32 extending through a frontside 22 of the case and adapted for connection with two engine manifold exhaust pipes (not shown) which are located outside the case. The outlet end 62 of an outlet pipe 60 is also shown as extending through a backside 26 of the enclosed muffler case 20, and may also be adapted for connection with a tailpipe that is located outside the case.

Figure 2:
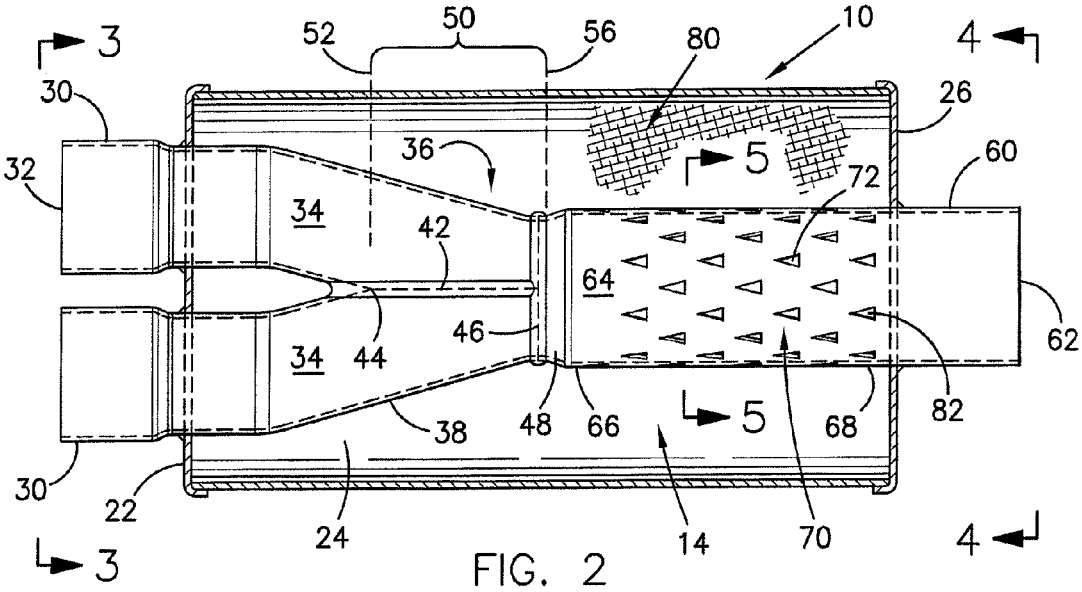
FIG. 2 is an internal transverse section of the crossover muffler of FIG. 1 as taken along section line 2-2, in accordance with another representative embodiment.

An internal transverse section of the crossover muffler 10 is shown in FIG. 2, and illustrates the exhaust piping assembly 14 installed within the muffler case 20 having a Y-Pipe exhaust system configuration. As can be seen, the respective interior ends 36 of the two inlet pipes 30 opposite the inlet ends 32 are merged together at a merge inlet 52 so as to create a merge zone 50 for the flow passages 34 inside the inlet pipes 30. The merge zone 50 provides for the communication and commingling of the exhaust flows from the two engine manifold exhaust pipes, and for reducing the peak pressures and back pressure build-up while allowing for the more efficient discharge of exhaust gases.

The sidewalls 38 of the inlet pipes 30 that enclose the flow passages 34 remain substantially solid and without any openings or apertures which would allow communication of an exhaust flow with the interior 24 of the case as the exhaust travels from the engine exhaust manifold and through the inlet pipes 30 to enter the merge zone 50, so as to isolate the exhaust flows from the inside of the case during passage through the inlet pipes and the merge zone. As may be appreciated by one of skill in the art, when configured correctly the inlet piping 30 and the merge zone 50 provide for the scavenging of one exhaust header by the high-velocity exhaust flow traveling through the other exhaust header, so as to lower the effective back pressure acting on the engine with a corresponding increase in performance.

Also shown in FIG. 2 is the single outlet pipe 60 that is located inside the case 20 and which has an interior end 66 opposite the outlet end 62 that defines a merge exit 56. In the Y-Pipe embodiment 10 of the crossover muffler, the merge exit 56 can be defined as the location in the flow passage where the dual flow passages 34 from the inlet pipes 30 have completely merged into a single flow passage 64 of the outlet pipe 60. In one aspect the merge exit 56 can also define a 'choke' point 46, in which the merging flow passages 34 of the inlet piping 30 in the merge zone 50 encounter their smallest cross-sectional area, after which the cross-sectional area immediately can expand in a transition section 48 to the interior diameter of the outlet pipe's flow passage 64. Nonetheless, it is to be understood that only one of the two inlet pipes 30 will normally be filled with an exhaust flow at any one moment in time, so that the effective cross-sectional area encountered by any single pulse of exhaust flow can continuously increase as the flow transitions the exhaust piping assembly 14 from the inlet end 32 of one of the inlet pipes 30 to the outlet end 62 of the outlet pipe 60.

Figure 3:
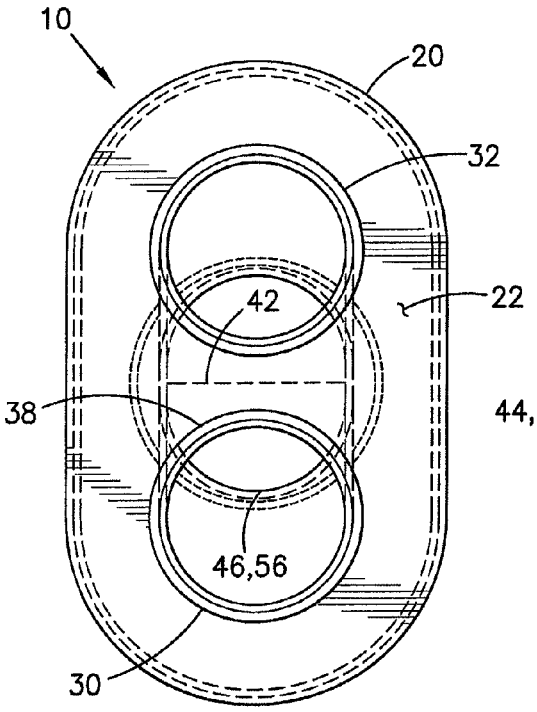
FIG. 3 is an input end elevation of the crossover muffler of FIG. 2 as taken along section line 3-3.
Figure 4:
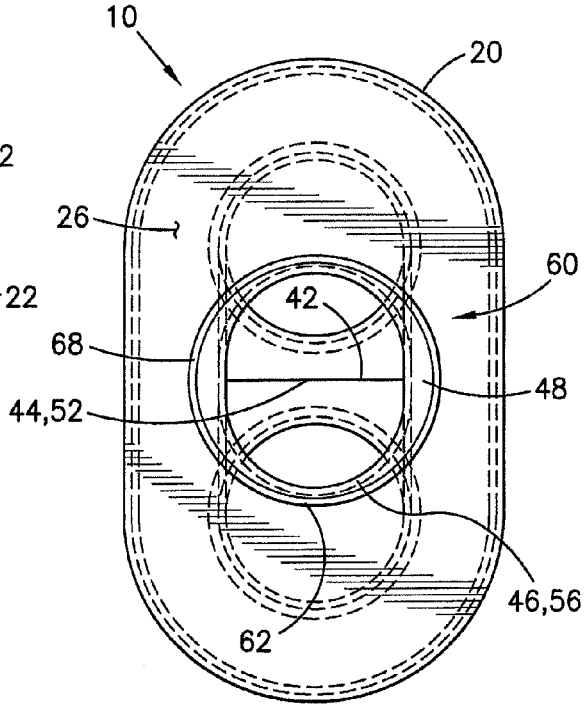
FIG. 4 is an output end elevation of the crossover muffler of FIG. 2 as taken along section line 4-4.

End views of the crossover muffler 10, as viewed from the frontside 22 and from the backside 26 of the case 20, are illustrated in FIGS. 3 and 4, respectively. Looking first through the outlet end 62 of the outlet pipe 60 shown in FIG. 4 (and with additional reference to FIG. 2), the center, leading portion 44 of the curved merge edge 42 that is formed by the coming together of the side-by-side inside surfaces of the inlet pipe sidewalls 38 (FIG. 3) define the merge inlet 52 of the merge zone 50. Moreover, as the two substantially round cross-sections of the inlet pipes 30 come together at an angle, the merging can eventually become complete as the two cross sections join together at the choke point 46, which in one aspect can have an oval-shaped cross-section having a height that is substantially equal to the diameter of both inlet pipes. The choke point 46 can also define the merge exit 56 of the merge zone 50. The short oval-to-round transition section 48 can then be used to expand the flow path from the ovalized choke 46 to the round cross-sectional area defined by the interior surfaces of the outlet pipe sidewalls 68.

Furthermore, in one aspect the outlet pipe 60 can have an internal diameter that is at least equal to or greater than about 1.2 times the internal diameter of either inlet pipe 30, to further ensure the continuous expansion of the exhaust flow as it travels through the exhaust piping assembly 14.

The portion of the sidewalls 68 of the outlet pipe 60 between the merge exit 56 and the backside 26 of the case 20 include one or more apertures or perforations 70 formed therein to allow communication of the exhaust flow inside the outlet pipe flow passage 64 and the inside 24 of the muffler case 20. As shown in both FIGS. 2 and 5, in one aspect the one or more apertures 70 can be a plurality of radial openings 72 having one of a variety of shapes, such as a plurality of triangular-shaped openings 82 extending completely through the thickness of the sidewalls 68 of the outlet pipe 60. It may also be understood that a variety of other shapes for the radial openings 72 are also possible, including but not limited to NACA duct-shaped apertures 84 (FIG. 6), slotted- or rectangular-shaped apertures 86 (FIG. 7), or elliptical-, obround- or circular-shaped apertures 88 (FIG. 8), etc., each of which can be considered to fall within the scope of the present invention.

Referring back to FIG. 2, in one aspect the inside volume 24 of the case between the exhaust piping assembly 14 and the sidewalls 68 and end plates 22, 26 of the case 20 can be filled with sound-dampening structures 80 or materials, such as fiberglass packing, etc., which can be resistant to the high temperature and/or corrosive environment created by the exhaust gases exiting the internal combustion engine. Moreover, the sound-dampening structures 80 can be configured to attenuate much of the acoustic energy being carried in the exhaust stream prior to exiting the crossover muffler 10 through the outlet end 66 of the outlet pipe.

Alternatively, the inside volume 24 of the muffler case 20 can be left substantially empty except for the exhaust piping assembly 14, and can act as a pressure or sound wave accumulator which temporarily receives and holds the high-energy sound waves emanating from the internal combustion engine while they are gradually dissipated and converted from sound energy into heat energy. In both configurations a negligible increase in heat generated by the attenuation and/or dissipation of the sound energy can subsequently be carried back into the outlet pipe 60 by that portion of the exhaust flow re-entering the outlet pipe 60 through some of the other radial apertures 72 formed through the sidewalls 68 of the interior end 66 of the outlet pipe 60.

As stated above, the performance-enhancing crossover muffler 10 described herein can include an exhaust piping assembly 14 within a muffler case 20 having a Y-Pipe configuration, and wherein the perforations 70 in the exhaust piping do not begin until after the merging of the inlet pipes 30 in the merge zone 50 is complete. The Inventor has found that the perforations 70 in the inlet pipes 30, or the merge zone 50, or at any point prior to the merge exit 56, as found in the prior art, can detract from the scavenging performance of the crossover muffler configuration. In contrast, the scavenging action of the crossover muffler 10 described herein can be optimized by limiting the perforations 70 to only those portions of the exhaust pipe assembly located after the inlet pipes 30 have come together and the crossover/scavenging action between the two inlet arms of the exhaust piping assembly has been achieved (e.g. at the merge exit 56). In other words, the crossover/scavenging action can be maintained in the inlet 30 and merging 50 portions of the crossover muffler, while the sound-attenuating muffler action can be provided by the perforations 70 in the outlet portion 60 of the exhaust piping assembly 14.

Furthermore, in one aspect the one or more apertures 70 in the outlet pipe 60 can be separated from the merge exit 56 by a distance that is at least equal to or greater than one half the diameter of the outlet pipe, so as to ensure completion of the crossover/scavenging action of the exhaust piping system prior to initiation of the sound-attenuating action provided by the perforations 70.

Figure 9:
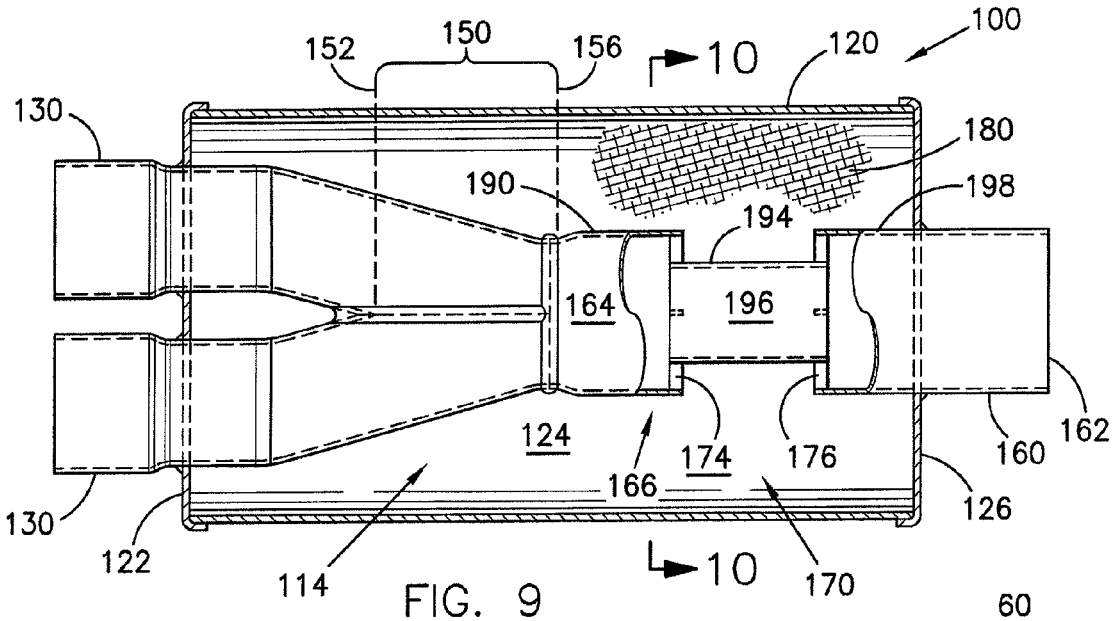
FIG. 9 is an internal transverse section of the crossover muffler of FIG. 1, in accordance with another representative embodiment.
Figure 5:
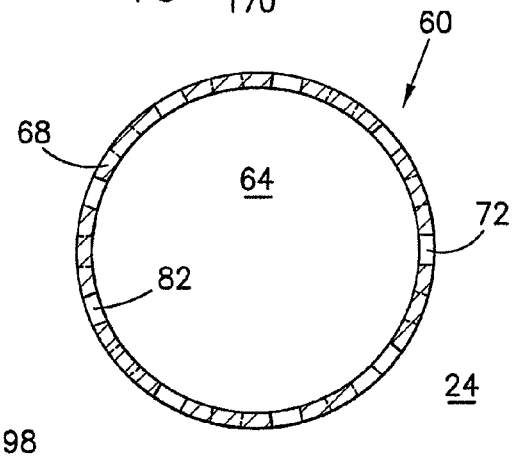
FIG. 5 is a vertical section of the crossover muffler of FIG. 2 as taken along section line 5-5.
Figure 10:
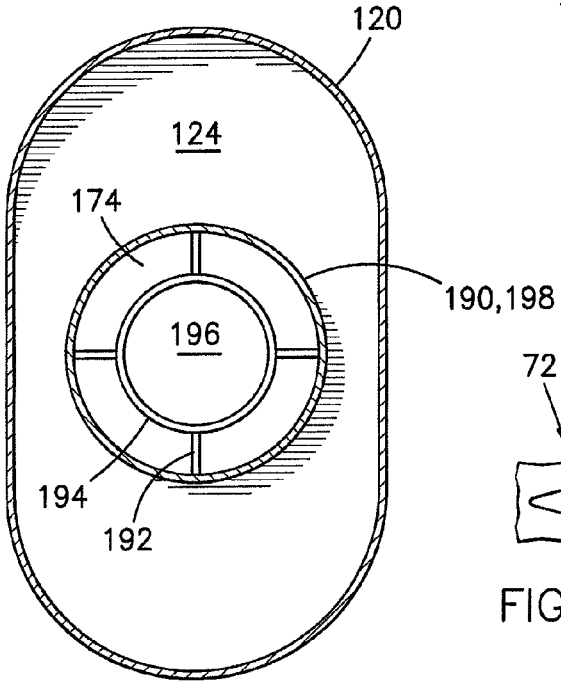
FIG. 10 is vertical section of the crossover muffler of FIG. 9 as taken along section line 10-10.
Figure 6:
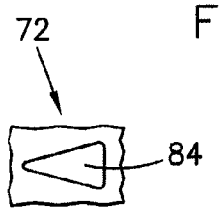
FIG. 6 is a top plan view of a NACA duct-type perforation that can be used in a representative embodiment of the crossover muffler.
Figure 7:
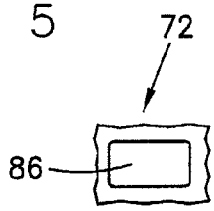
FIG. 7 is a top plan view of a rectangular-type perforation that can be used in a representative embodiment of the crossover muffler.
Figure 8:
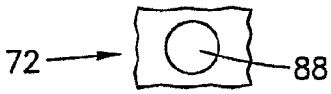
FIG. 8 is a top plan view of a circular-type perforation that can be used in a representative embodiment of the crossover muffler.

Referring now to FIGS. 9 and 10, illustrated therein is another embodiment 100 of the performance-enhancing crossover muffler also having two inlet pipes 130 entering through a frontside 122 of an enclosed muffler case 120 and merging together to define a merge zone 150 having a merge inlet 152 and a merge exit 156, similar to the embodiment described above. Upon passing into the interior end 166 of the outlet pipe 160, a portion of the exhaust flow can pass through the one or more apertures 170 in the outlet pipe 160 that allow for communication between the inside flow passage 164 and the inside 124 of the case 120. Instead of a plurality of radial openings, however, the apertures 170 in the crossover muffler 100 can comprise one or more annular openings 174, 176 between a plurality of intermediate sections 190, 194, 198 of the outlet pipe 160 having different diameters.

For example, in one aspect the interior portion 166 of the outlet pipe 160 located inside the case 120 can be sub-divided into three intermediate sections, namely front section 190, middle section 194, and a back section 198. The front and back sections 190, 198 can have the same internal diameter as the outlet pipe 160, while the middle section 194 can have a diameter less than the diameter of the outlet pipe 160, or even less than the diameter of one of the inlet pipes 130. Furthermore, the middle section 194 can be supported in a coaxial position between the front and back sections with a plurality of support braces 192 (see FIG. 10). As a result, the first annular gap 174 between the front 190 and middle 194 intermediate sections provides an opening for a portion of the exhaust flow passing through the crossover muffler to enter the inside 124 of the muffler case 120, while the remainder of the exhaust flow passes through the interior flow passage 196 of the middle section 194. The portion of the exhaust flow which enters the interior volume 124 of the case 120 can eventually re-enter the outlet pipe 160 through a second annular opening 176 between the middle 192 and back 194 intermediate sections.

Referring back to FIG. 9, in one aspect a portion of the inside volume 124 of the muffler case 120 outside the exhaust piping assembly 114, and between the end plates 122, 126 can be filled with sound-dampening structures 180, such as fiberglass packing, etc., which can be resistant to the high temperature and corrosive environment created by the exhaust gases exiting the internal combustion engine. As described above, the sound-dampening structures 180 can be configured to attenuate much of the acoustic energy carried in the exhaust streams. Alternatively, the inside volume 124 of the case 120 can be left substantially empty except for the exhaust piping assembly 114, and can act as a pressure or sound wave accumulator which temporarily receives and holds the high-energy sound waves emanating from the internal combustion engine while they are gradually dissipated and converted from sound energy into heat energy. In both configurations the negligible increase in heat generated by the attenuation and/or dissipation of the sound energy can subsequently be carried back into the outlet pipe 160 through the second annular opening 176 by the portion of exhaust flow returning to the exhaust stream prior to exiting the crossover muffler 100 through the outlet end 162 of the outlet pipe.

Figure 11:
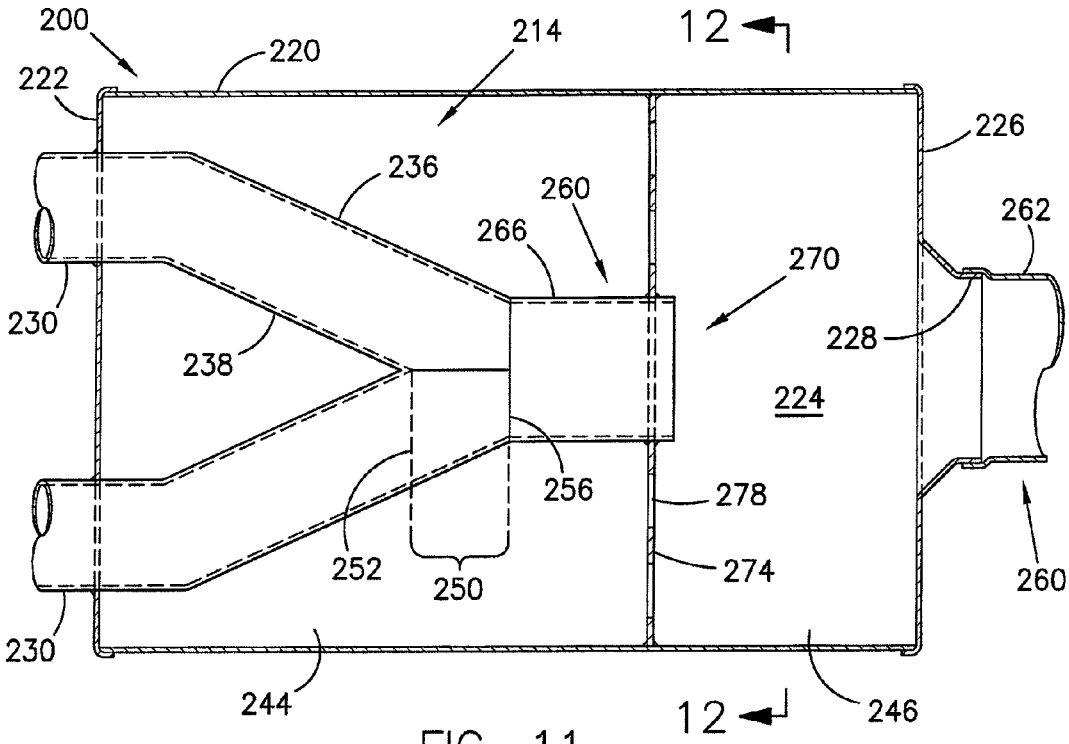
FIG. 11 is an internal transverse section of the crossover muffler of FIG. 1, in accordance with another representative embodiment.
Figure 12:
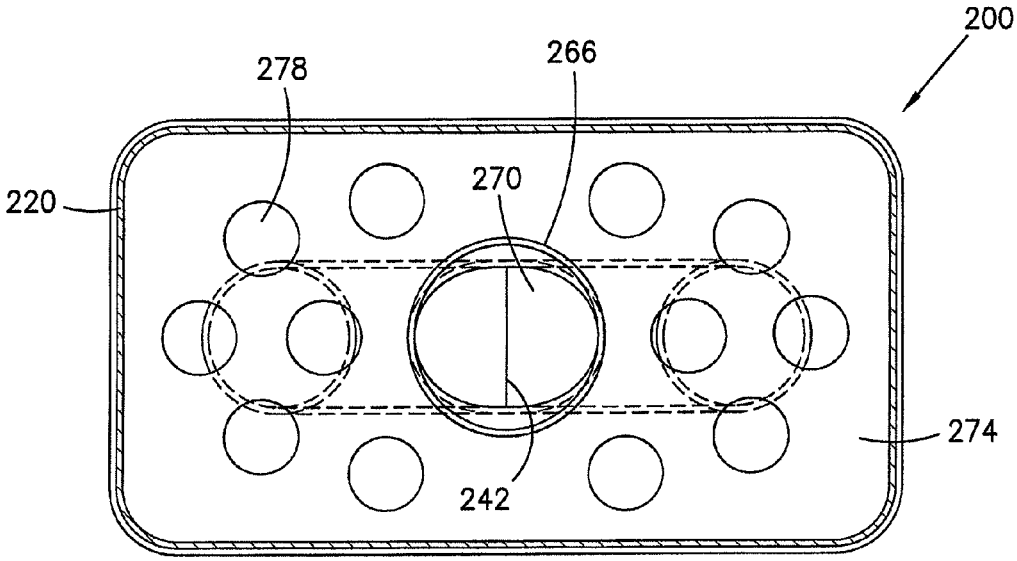
FIG. 12 is vertical section of the crossover muffler of FIG. 11 as taken along section line 12-12.

Illustrated in FIGS. 11 and 12 is a crossover muffler 200 in accordance with yet another representative embodiment. Similar to the embodiments described above, the crossover muffler 200 includes an exhaust piping assembly 214 also having two inlet pipes 230 entering through a frontside 222 of an enclosed muffler case 220 and merging together to define a merge zone 250 having a merge inlet 252 and a merge exit 256, with the merge exit being in communication with the interior end portion 266 of an outlet pipe 260. Upon passing into the interior end portion, however, the entire exhaust flow then flows into the interior 224 of the case 220 through a complete break or opening 270 that separates the outlet pipe 260 into the interior end portion 266 and an outlet end portion 262.

The interior end portion 266 of the outlet pipe 260 can be supported by a baffle plate 274 that spans that interior cross section of the case 220, and which can have a plurality of apertures 278 or perforations formed therein (see also FIG. 12) to allow the exhaust flow to turn and pass forward into the front portion 244 of the interior volume 224 that surrounds the interior end portions 236 of the inlet pipes 230 and the merge zone 250. The apertures 278 or perforations can be sized and shaped to provide additional attenuation of the sound energy as the exhaust flow travels between the front 244 and rear 246 portions of the interior volume 224 of the case 220. Also shown in FIG. 12 is the curved merge edge 242 that is formed by the coming together of the side-by-side inside surfaces of the inlet pipe sidewalls 238.

The outlet end 262 of the outlet pipe 260 can extend directly from the backside 226 of the case 220 and can be adapted for connection with an outside tailpipe. However, in the aspect shown in FIG. 11, the outlet end 262 is shown coupled around an outlet nipple 228 formed into and extending from backside 226 of the muffler case 220. It is to be understood that other configurations for both the interior baffle plate 274 and for coupling the outlet end 262 of the outlet pipe 260 to the backside 226 of the muffler case 220 are also possible, and are included within the scope of the present invention. What has been described and referred to as the outlet end 262 of outlet pipe 260 could alternatively be the inlet end of an outside exhaust pipe coupled directly to outlet nipple 228.

Figure 13:
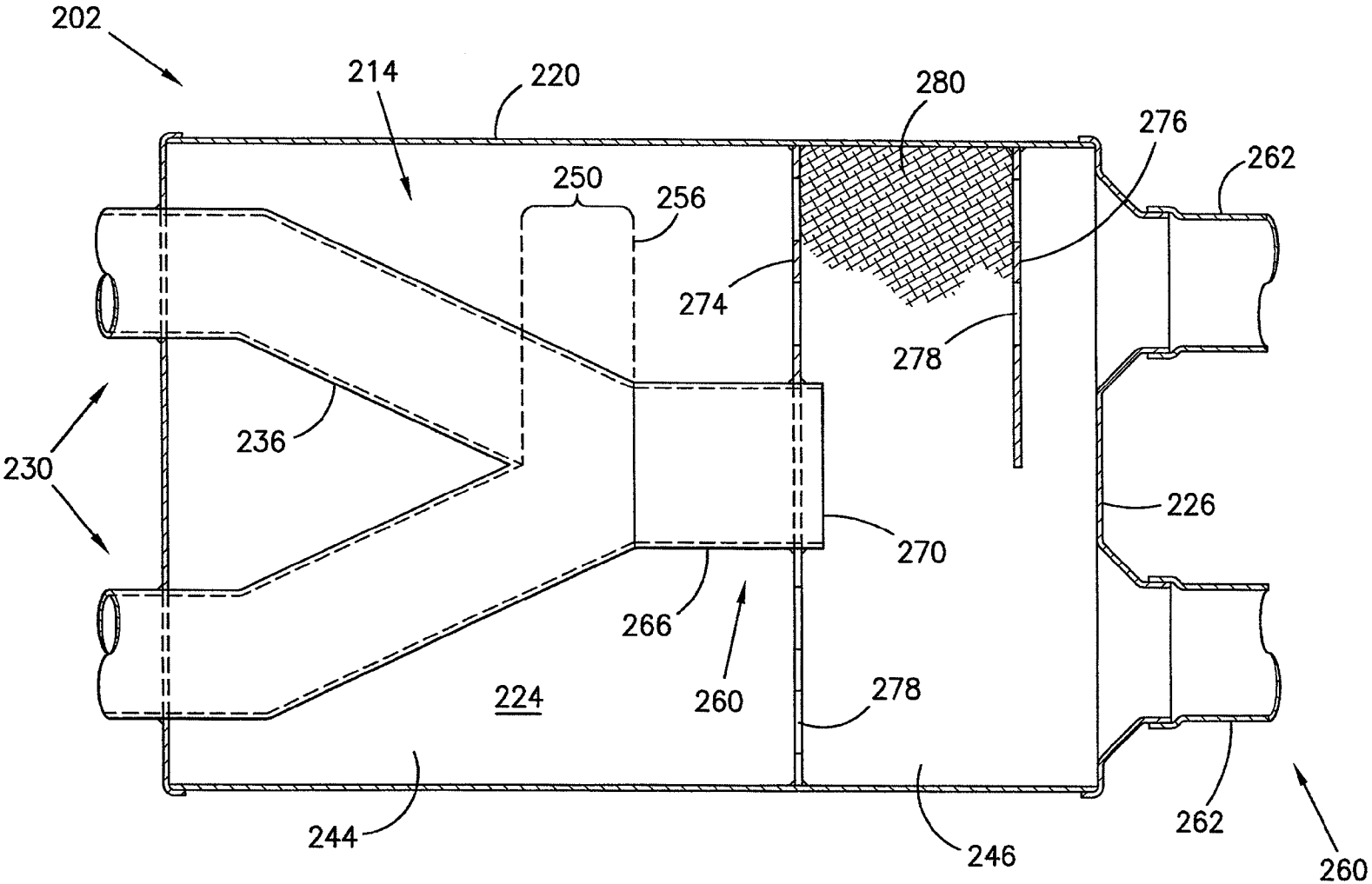
FIG. 13 is an internal transverse section of the crossover muffler, in accordance with yet another representative embodiment.

Another similar embodiment 202 of the crossover muffler having a complete break or opening 270 in the outlet pipe 260 that separates the outlet pipe into an interior end 266 and one or more outlet ends 262 is shown in FIG. 13. In this configuration, however, the single outlet end can be divided into two outlets ends 262 extending through the backside 226 of the muffler case 220, with the outlet ends being adapted for connection with two outside tailpipes (not shown). The capability for accommodating several types of exhaust piping assemblies, such as the various internal Y-Pipe and X-Pipe exhaust piping assemblies shown in FIGS. 2, 9, 11, 13 and 15, each of which can provide both for a crossover/scavenging action in the inlet and merging portions and for a sound-attenuating muffler action in the outlet portion, is one significant advantage of the crossover muffler described herein.

Referring back to FIG. 13, the interior end portion 266 of the outlet pipe 260 can be supported by a baffle plate 274, as shown in FIG. 12, that spans that interior cross section of the case 220, and which can have a plurality of apertures 278 or perforations formed therein that allow the exhaust flow to pass forward into the front portion 244 of the interior volume 224 that surrounds the interior ends 236 of the inlet pipes 230 and the merge zone 250. In one aspect of the embodiment of FIG. 13, a second baffle plate 276 can be installed proximate to the backside 226 of the muffler case 220, and can also have a plurality of apertures 278 or perforations formed therein to allow the exhaust flow to pass rearward into the outlet ends 262 of the outlet pipes 260. This second baffle plate 276 can span completely across the internal cross section of the case 220 similarly to baffle plate 274, or can span only a portion of the internal cross section of the case 220, as shown.

In addition to the perforations 278 in the two baffle plates 274, 276 being sized and shaped to provide additional attenuation of the sound vibrations as the exhaust flow travels between the front 244 and rear 246 portions of the interior volume 224, the volume in-between the two baffle plates 274, 276 can be filled with sound-dampening structures 280, such as fiberglass packing, etc., which can be configured to attenuate an additional portion of the acoustic energy carried in the exhaust streams. Alternatively, the inside volume 224 of the case 220 can be left substantially empty except for the exhaust piping assembly 214 and the support baffle plate 274, and can act as a pressure or sound wave accumulator which temporarily receives and holds the high-energy sound waves emanating from the internal combustion engine while they are gradually dissipated and converted from sound energy into heat energy.

Also illustrated in both FIGS. 11 and 13, in one aspect the break 270 or opening in the outlet pipe 260 can be spaced away from the merge exit 256 of the merge zone 250 by a distance that is at least equal to or greater than one half the diameter of the interior end portion 266 of the outlet pipe 260, so as to ensure completion of the crossover/scavenging action of the exhaust piping assembly 214 prior to initiation of the sound-attenuating action provided by the inside volume 224 of the case 220, the perforations 278 in the supporting baffle plates, or any sound-dampening structure 280 installed within the case 220, or combinations thereof, etc. Again, it should be noted that there are no perforations and no communication between the interior 224 of the case 220 and the inside of the inlet pipes 230, the merge zone 250, and the outlet pipe 260 upstream of the outlet pipe opening or break 270.

Figure 14:
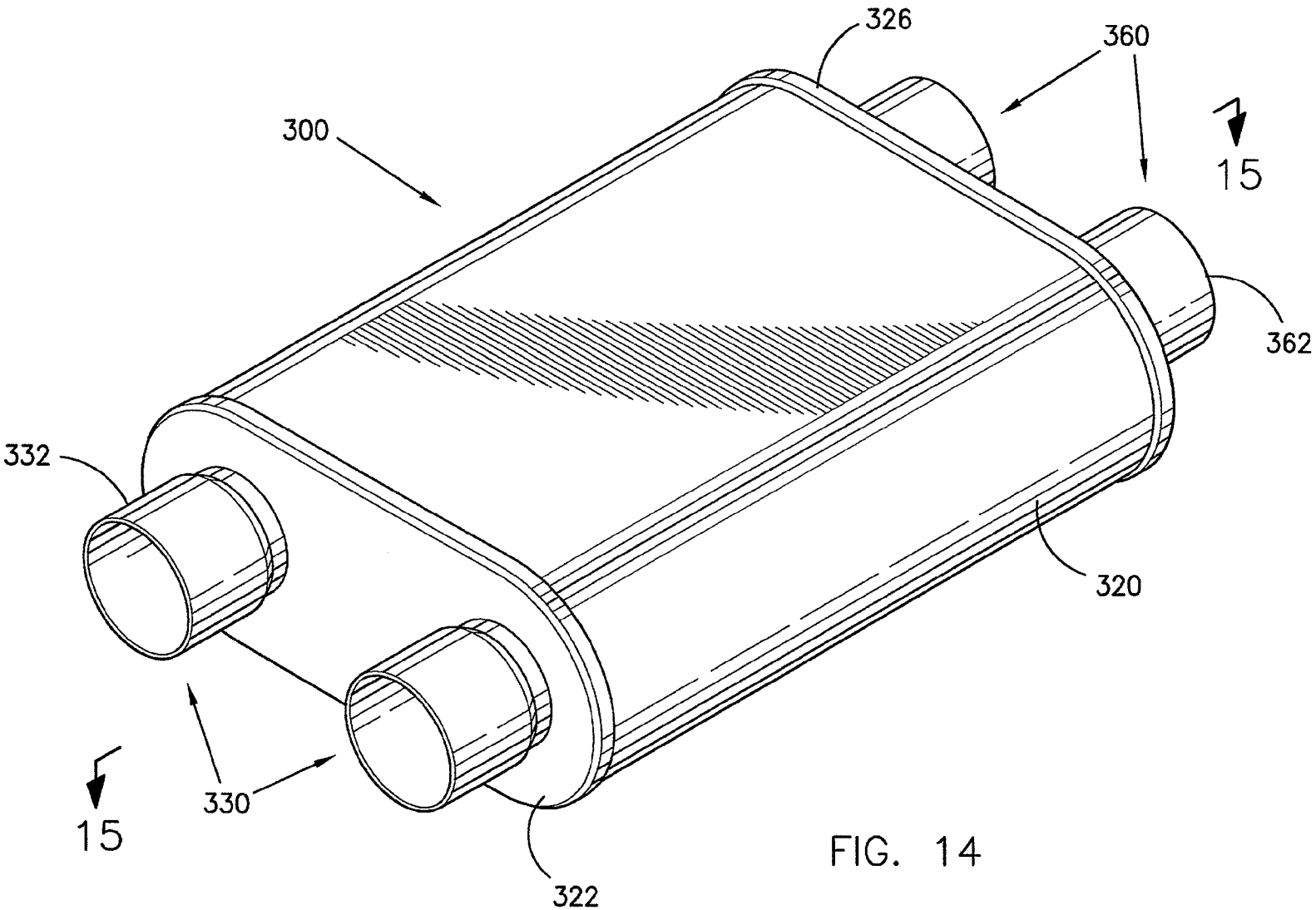
FIG. 14 is an exterior perspective view of a crossover muffler, in accordance with yet another representative embodiment.

FIG. 14 is an exterior perspective view of another representative embodiment 300 of the performance-enhancing crossover muffler. Like the two exemplary embodiments described above, the crossover muffler 300 includes an enclosed case 320 having two inlet pipes 330 with inlet ends 332 extending through a frontside 322 of the case, and which inlet ends can be adapted for connection with two engine manifold exhaust pipes (not shown) that are located outside the case. In contrast with the previously described embodiments, however, the single outlet pipe has been replaced with two outlet pipes 360 having outlet ends 362 extending through a backside 326 of the enclosed case 320, and which can be adapted for connection with two separate tailpipes (not shown) that are also located outside the case. Moreover, the diameter of each of the two outlet pipes 360 can be substantially equal to or greater than the diameter of each of the two inlet pipes 330.

Figure 15:
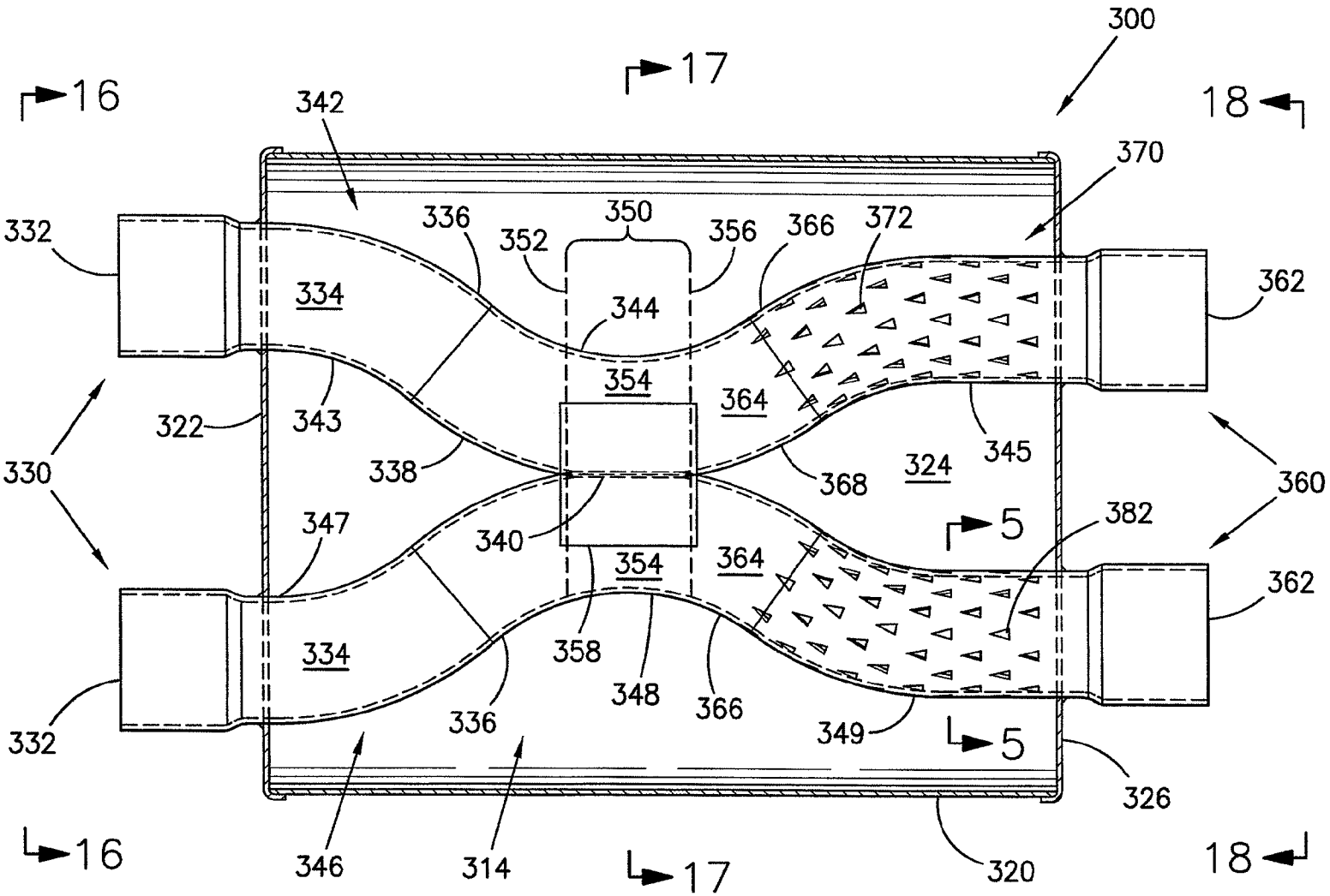
FIG. 15 is an internal transverse section of the crossover muffler of FIG. 14 as taken along line 15-15, in accordance with another representative embodiment.

An internal transverse section of the crossover muffler 300 is shown in FIG. 15 and illustrates the exhaust piping assembly 314 installed within the muffler case 320 having an X-Pipe configuration. As can be seen, the respective interior ends 336 of the two inlet pipes 330 opposite the inlet ends 332 can be merged together at a merge inlet 352 so as to create a merge zone 350 for the exhaust flow traveling through the inside flow passages 334 of the inlet pipes 330. In the merge zone 350 one or more apertures 340 can be formed between the side-by-side contacting sidewalls 338 of the inlet pipes 330, which can provide for the commingling of the exhaust flows from the two engine manifold exhaust pipes. Other than the aperture(s) 340 interconnecting the interior passages 334 of the two inlet pipes, however, the sidewalls 338 of the inlet pipes 330 that enclose the interior flow passages 334 can be substantially solid and without any openings or apertures which would otherwise allow communication of an exhaust flow with the inside 324 of the case 320 as the exhaust travels from the engine exhaust manifold and through the inlet pipes 330 to enter the merge zone 350. As may be appreciated by one of skill in the art, a correctly-configured X-pipe arrangement can provide for the scavenging of one exhaust header by the high-velocity exhaust flow traveling through the other exhaust header, so as to lower the effective back pressure acting on the engine with a corresponding increase in performance.

Also shown in FIG. 15 are the outlet pipes 360 located inside the case 320 having interior ends 366 opposite the outlet ends 362 that come together to define a merge exit 356. In the dual outlet pipe 360 embodiment of the crossover muffler 300, the merge exit can be defined as the location in the exhaust piping assembly 314 where the two interior flow passages 354 through the merge zone 350 cease to communicate with each other through the common aperture 340 in the contacting sidewalls of the inlet pipes, and separate into their respective outlet pipe interior flow passages 364 that are enclosed by the sidewalls 368 of the two exit pipes 360.

The portion of the sidewalls 368 of each outlet pipe 360 between the merge exit 356 and the backside 326 of the case 320 can include one or more apertures or perforations 370 formed therein to allow communication of the exhaust flow inside the flow passages 364 with the inside 324 of the case. Furthermore, in one aspect the one or more apertures 370 in each of the outlet pipes 360 can be separated from the merge exit 356 by a distance that is at least equal to or greater than one half the diameter of the outlet pipe, so as to ensure completion of the crossover/scavenging action of the exhaust piping system prior to initiation of the sound-attenuating action provided by the apertures 370.

The apertures 370 can be radial openings 372 having one of a variety of shapes, such as the plurality of triangular-shaped openings 382 shown in FIG. 15 that extend completely through the thickness of the sidewalls 368 of the outlet pipes 360. However, a wide variety of other simple or complex shapes for the radial openings 372 are also possible, including but not limited to NACA duct-shaped apertures 84 (FIG. 6), slotted- or rectangular-shaped apertures 86 (FIG. 7), or elliptical-, obround- or circular-shaped apertures 88 (FIG. 8), etc., each of which can be considered to fall within the scope of the present invention. In other aspects the apertures 370 can be annular openings between a plurality of substantially coaxial intermediate sections of the outlet pipe having different diameters, as described and illustrated with references to FIGS. 6-7 above. Regardless of the type, shape, or number of apertures 370 providing communication between the interior flow passages 364 of the outlet pipes 360, both the inlet pipes 330 and the piping merge zone 350 are without communication with the inside 324 of the muffler case 320, so as to isolate the exhaust flows from the inside of the case during passage through the inlet pipes and the merge zone.

In one embodiment the crossover muffler can include inlet pipes and outlet pipes as separate components that can be coupled together through a merge zone component which provides the interconnection between the two interior flow passages. In the embodiment of the crossover muffler 300 illustrated in FIG. 15, however, the exhaust piping assembly 314 may be configured so that one of the two inlet pipes 330 and one of the two outlet pipes 360 comprise a single pipe 342 having an inlet section 343, an outlet section 345 and a mid-span section 344. Similarly, the other set of inlet 330 and outlet 360 pipes can comprise another single pipe 346 also having an inlet section 347, an outlet section 349 and a mid-span section 348. The inlet sections 343, 347 of both pipes 342, 346 can have inlet ends 332 adapted for connection with two engine manifold exhaust pipes, and the outlet sections 345, 349 of both pipes 342, 346 can have outlet ends 362 adapted for connection with tailpipes. Furthermore, the two mid-span sections 344, 348 can be coupled together to form the piping merge zone 350 for commingling the exhaust flows from the engine manifold exhaust pipes.

Finally, one or more apertures 370 can be formed in both outlet sections 345, 349 to provide communication with the inside 324 of the case 300. In some aspects the apertures can be radial apertures 372 through the thickness of the sidewalls 368 of the outlet sections 345, 349, as shown in FIG. 15, while in other aspects the apertures can be annular openings between a plurality of substantially coaxial intermediate sections of the outlet pipe having different diameters, as described and illustrated with references to FIGS. 9-10 above.

Regardless of the type, shape or number of the one or more apertures 370 providing communication between the interior flow passages 364 of the outlet sections 345, 349 and inside 324 of the muffler case 320, the inlet 343, 347 and mid-span sections 344, 348 of both pipes 342, 346 are without communication with the inside 324 of the case 320.

Although not shown in FIG. 15, it is to be appreciated that a portion of the inside volume 324 of the muffler case 320 can also be filled with sound-dampening structures such as fiberglass packing, etc., as described above, and which can be configured to attenuate much of the acoustic energy carried in the exhaust streams as described above. Alternatively, the inside volume 324 of the muffler case 320 can be left substantially empty except for the exhaust piping assembly 314, and can act as a pressure or sound wave accumulator which temporarily receives and holds the high-energy sound waves emanating from the internal combustion engine while they are gradually dissipated and converted from sound energy into heat energy. In both configurations the negligible increase in heat generated by the attenuation and/or dissipation of the sound energy can subsequently be carried back into the outlet pipes 360 by that portion of the exhaust flow reentering the outlet pipes through some of the other radial apertures 372 formed through the sidewalls 368 of the outlet pipes 360.

Figure 18:
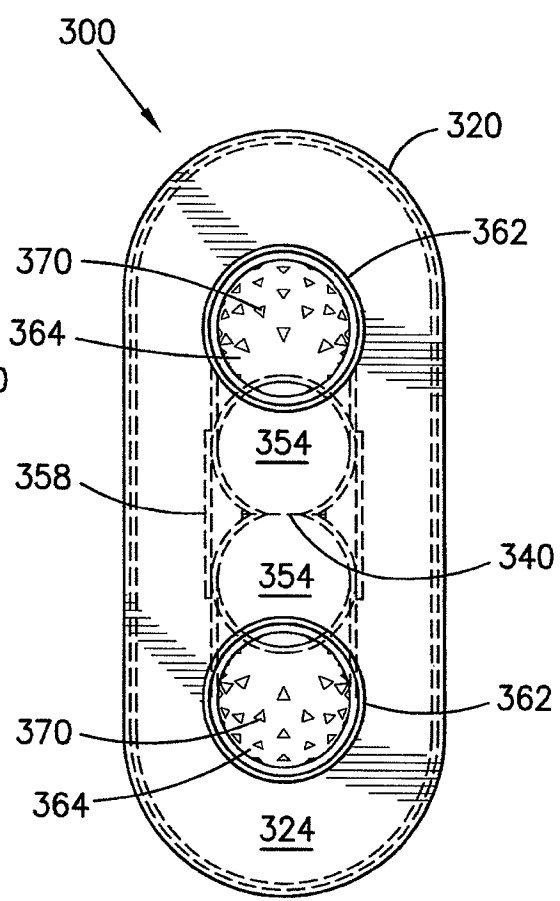
FIG. 18 is a vertical section of the crossover muffler of FIG. 15 as taken along section line 18-18.
Figure 17:
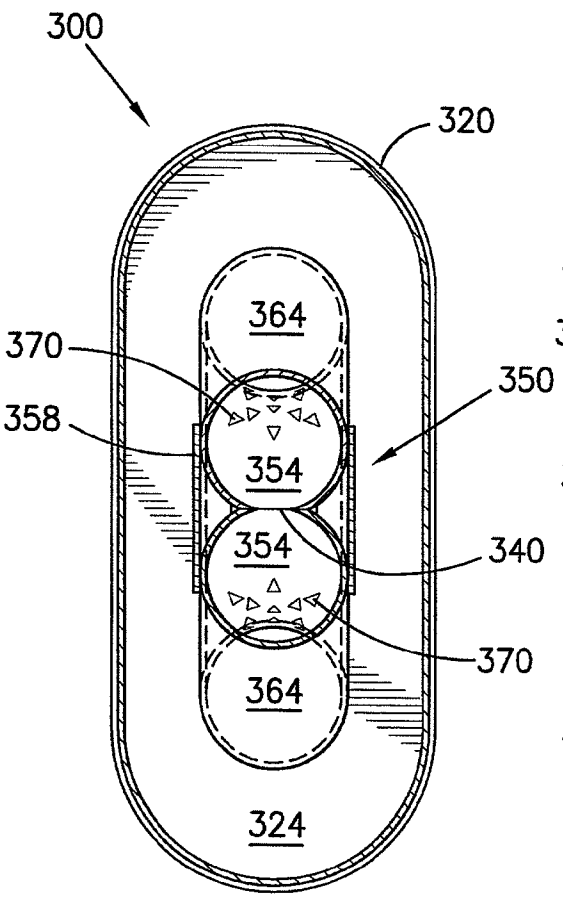
FIG. 17 is an outlet end elevation of the crossover muffler of FIG. 15 as taken along section line 17-17.
Figure 16:
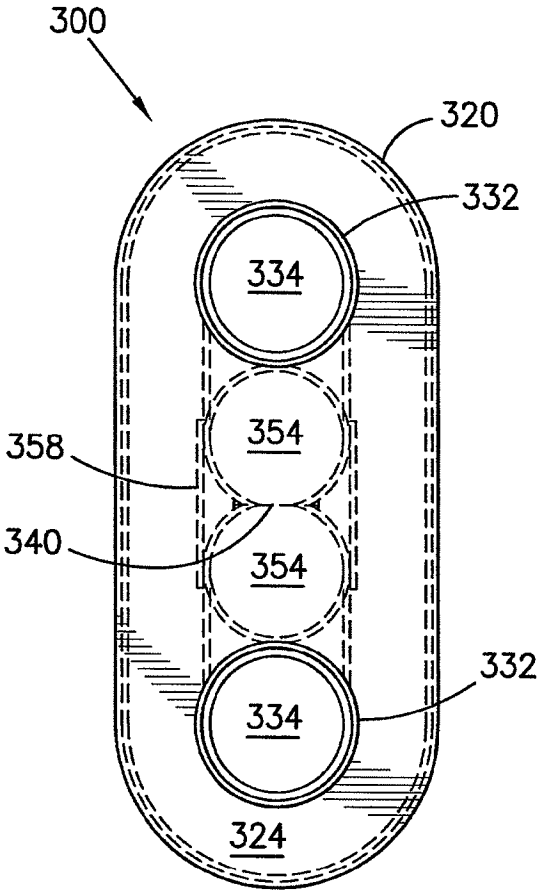
FIG. 16 is an input end elevation of the crossover muffler of FIG. 15 as taken along section line 16-16.

FIGS. 16-18 together illustrate the inlet end elevation, the outlet end elevation, and a vertical section of the crossover muffler 300 of FIG. 15 as taken along sections lines 16-16, 17-17, and 18-18, respectively. Looking first through the inlet ends 332 of the inlet pipes 330 shown in FIG. 16 (and with additional reference to FIG. 15), the inlet pipe flow passages 334 can curve inwardly towards each other until the side-by-side inside sidewalls 338 contact and are coupled together and the one or more apertures 340 are formed therethrough to provide communication between the two interior flow passages 354 in the merge zone 350, for the commingling of the exhaust flows and for the reduction of the peak pressures and the back pressure build-up while allowing for the more efficient discharge of exhaust gases. In one aspect the one or more apertures 340 can be a single, elongate longitudinal aperture or hole with rounded ends through the side-by-side coupled sidewalls of the two mid-span sections 346, 348.

As shown in FIGS. 17 and 18, the merge zone interior flow passages 354 can then separate back into two outlet pipe flow passage 364, both having communication with the inside 324 of the muffler case 320 through a plurality of apertures 370. In some aspects it may also be desirable to add reinforcement plates 358 to both sides of the exhaust piping assembly 314 in the merge zone 350 to provide additional structural support to the coupled mid-span section.

Figure 19:
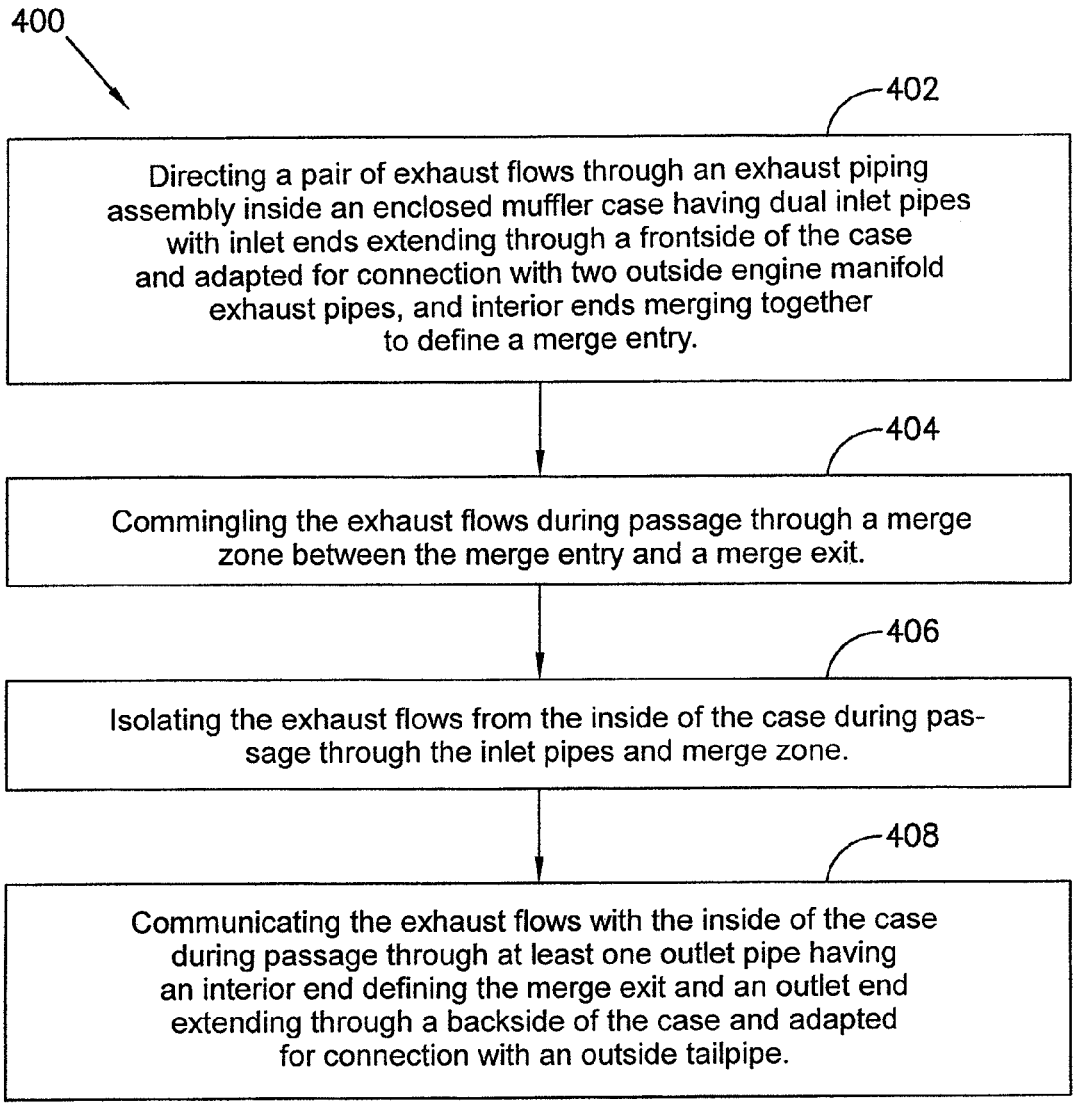
FIG. 19 is a flowchart depicting a method for attenuating acoustic noise in an exhaust flow, in accordance with one representative embodiment.

Illustrated in FIG. 19 is a flowchart depicting a method 400 for attenuating acoustic noise in a vehicular exhaust flow that includes directing 402 a pair of exhaust flows through an exhaust piping assembly inside an enclosed muffler case, in which the exhaust piping assembly comprises a set of dual inlet pipes with inlet ends extending through a frontside of the case that are adapted for connection with two outside engine manifold exhaust pipes, and with interior ends of the inlet pipes merging together to define a merge entry. The method also includes commingling 404 the exhaust flows during passage through a merge zone between the merge entry and a merge exit while isolating 406 the exhaust flows from the inside of the case during passage through the inlet pipes and merge zone. The method further includes communicating 408 the exhaust flows with the inside of the case during passage through at least one outlet pipe having an interior end defining the merge exit and an outlet end extending through a backside of the case and adapted for connection with an outside tailpipe.

Figure 20:
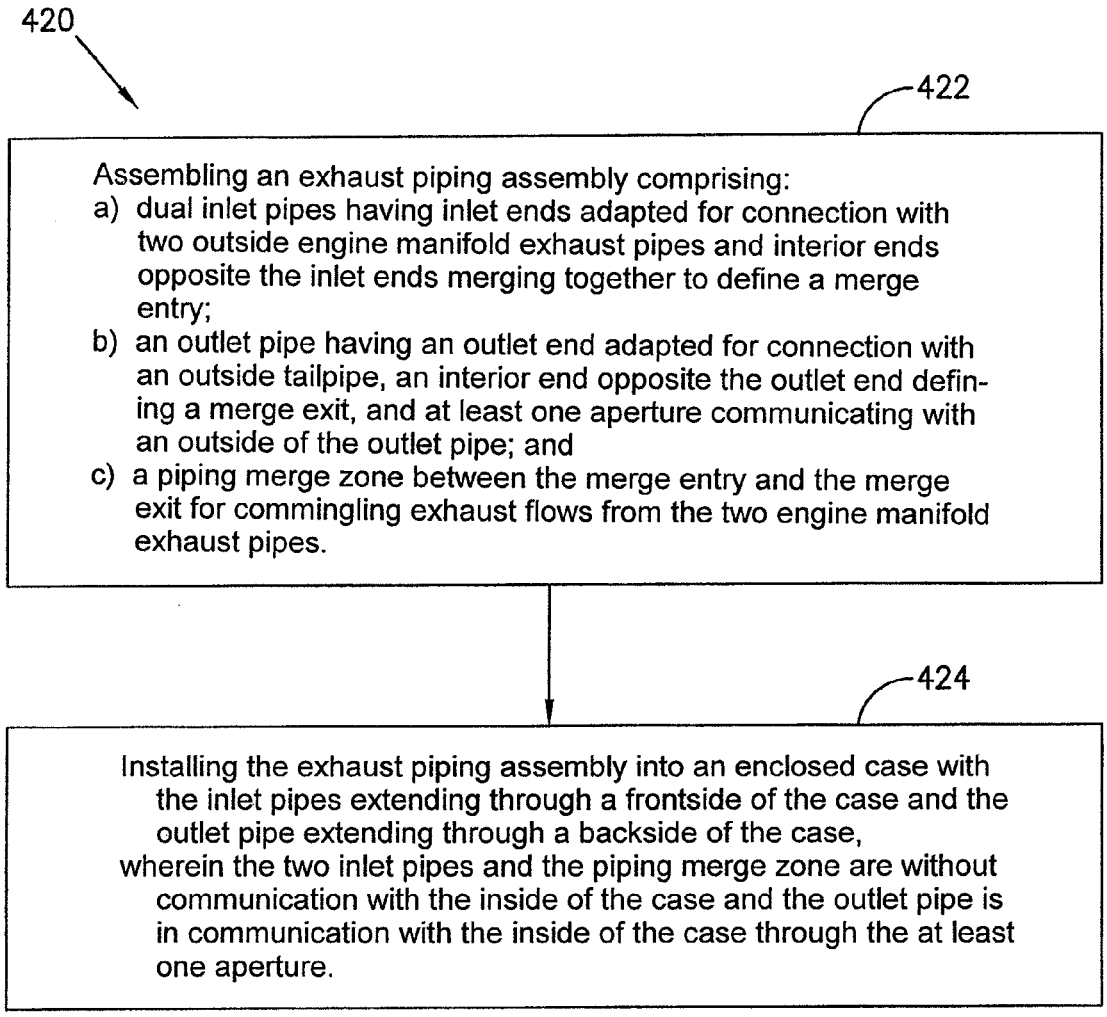
FIG. 20 is a flowchart depicting a method of making a performance-enhancing muffler for internal combustion engines, in accordance with another representative embodiment.

Illustrated in FIG. 20 is another flowchart depicting a method 420 of making a performance-enhancing muffler for internal combustion engines that includes the steps of assembling 422 an exhaust piping assembly comprising a) dual inlet pipes having inlet ends adapted for connection with two outside engine manifold exhaust pipes and interior ends opposite the inlet ends merging together to define a merge entry, b) an outlet pipe having an outlet end adapted for connection with an outside tailpipe, an interior end opposite the outlet end defining a merge exit, and at least one aperture communicating with an outside of the outlet pipe, and c) a piping merge zone between the merge entry and the merge exit for commingling exhaust flows from the two engine manifold exhaust pipes. The method further includes the step of installing 424 the exhaust piping assembly into an enclosed case with the inlet pipes extending through a frontside of the case and the outlet pipe extending through a backside of the case, and wherein the two inlet pipes and the piping merge zone are without communication with the inside of the case while the outlet pipe is in communication with the inside of the case through the at least one aperture.

Figure 21:
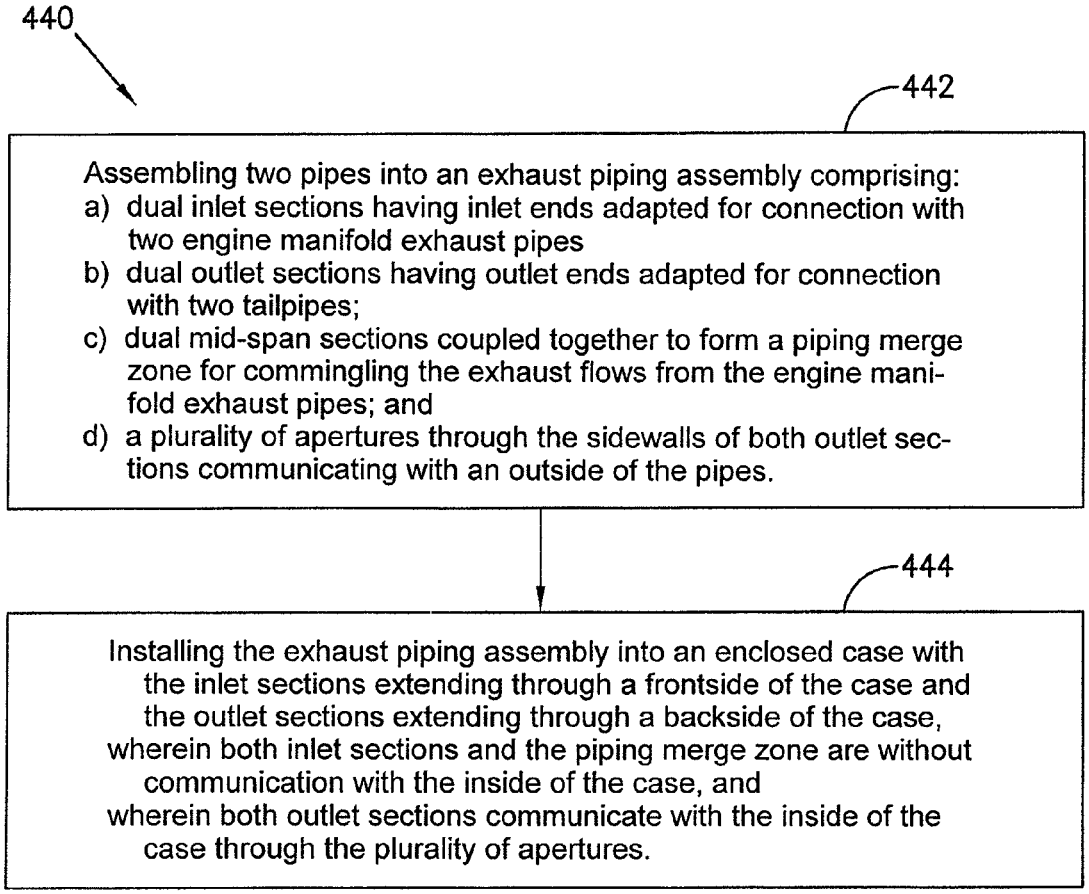
FIG. 21 is a flowchart depicting a method of making a performance-enhancing muffler for internal combustion engines, in accordance with yet another representative embodiment.

Illustrated in FIG. 21 is a flowchart depicting yet another method 440 of making a performance-enhancing muffler for internal combustion engines that includes the steps of assembling 442 two pipes into an exhaust piping assembly comprising a) dual inlet sections having inlet ends adapted for connection with two engine manifold exhaust pipes, b) dual outlet sections having outlet ends adapted for connection with two tailpipes, c) dual mid-span sections coupled together to form a piping merge zone for commingling the exhaust flows from the engine manifold exhaust pipes, and d) a plurality of apertures through the sidewalls of both outlet sections communicating with an outside of the pipes. The method further includes the step of installing 444 the exhaust piping assembly into an enclosed case with the inlet sections extending through a frontside of the case and the outlet sections extending through a backside of the case, wherein both inlet sections and the piping merge zone are without communication with the inside of the case, and further wherein both outlet sections are configured to communicate with the inside of the case through the plurality of apertures.

The foregoing detailed description describes the invention with reference to specific representative embodiments. However, it will be appreciated that various modifications and changes can be made without departing from the scope of the present invention as set forth in the appended claims. The detailed description and accompanying drawings are to be regarded as illustrative, rather than restrictive, and any such modifications or changes are intended to fall within the scope of the present invention as described and set forth herein.

More specifically, while illustrative representative embodiments of the invention have been described herein, the present invention is not limited to these embodiments, but includes any and all embodiments having modifications, omissions, combinations (e.g., of aspects across various embodiments), adaptations and/or alterations as would be appreciated by those skilled in the art based on the foregoing detailed description. The limitations in the claims are to be interpreted broadly based on the language employed in the claims and not limited to examples described in the foregoing detailed description or during the prosecution of the application, which examples are to be construed as non-exclusive. For example, any steps recited in any method or process claims, furthermore, may be executed in any order and are not limited to the order presented in the claims. The term "preferably" is also non-exclusive where it is intended to mean "preferably, but not limited to." Accordingly, the scope of the invention should be determined solely by the appended claims and their legal equivalents, rather than by the descriptions and examples given above.

What is claimed and desired to be secured by Letters Patent is:

What is claimed and desired to be secured by Letter Patent is:

1. A muffler for increasing engine performance while attenuating acoustic noise in a vehicular exhaust flow, comprising:

an enclosed case having an inside;

two inlet pipes located inside the case comprising:

respective inlet ends extending through a frontside of the case and adapted for connection with two outside engine manifold exhaust pipes; and respective interior ends opposite the inlet ends merging together to define a merge entry;

at least one outlet pipe located inside the case comprising:

an outlet end extending through a backside of the case and adapted for connection with an outside tailpipe;

an interior end opposite the outlet end defining a merge exit; and at least one aperture in the outlet pipe communicating with the inside of the case; and a piping merge zone between the merge entry and the merge exit for commingling exhaust flows from the two engine manifold exhaust pipes, wherein the two inlet pipes and the piping merge zone are without communication with the inside of the case.

2. The muffler of claim 1, wherein the at least one outlet pipe further comprises a single outlet pipe having an outlet end adapted for connection with a single outside tailpipe.

3. The muffler of claim 2, wherein the at least one aperture in the outlet further comprises a plurality of radial openings through a sidewall of the outlet pipe.

4. The muffler of claim 3, wherein the plurality of radial openings further comprise a plurality of shaped apertures selected from the group consisting of triangular-, NACA duct-, rectangular-, obround-, elliptical- and round-shaped apertures, and combinations thereof.

5. The muffler of claim 2, wherein the at least one aperture in the outlet pipe further comprises an annular opening between a plurality of substantially coaxial intermediate sections of the outlet pipe having different diameters.

6. The muffler of claim 5, wherein one of the intermediate sections has a diameter smaller than a diameter of the inlet pipes.

7. The muffler of claim 1, wherein the at least one aperture in the at least one outlet pipe further comprises an opening formed by a break in the outlet pipe operable to separate the outlet pipe into the outlet end and the interior end.

8. The muffler of claim 7, wherein the interior end of the at least one outlet pipe is supported by an interior baffle plate.

9. The muffler of claim 8, wherein the at least one outlet pipe further comprises a single interior end and two outlet ends adapted for connection with two outside tailpipes.

10. The muffler of claim 1, wherein the at least one outlet pipe further comprises two outlet pipes merged together at the merge exit and having two outlet ends adapted for connection to two outside tailpipes, respectively.

11. The muffler of claim 10, wherein the at least one aperture in the outlet pipes further comprise a plurality of radial openings through sidewalls of both outlet pipes.

12. The muffler of claim 10, wherein the at least one aperture in the outlet pipes further comprises an annular opening between a plurality of substantially coaxial intermediate sections of each outlet pipe having different diameters.

13. The muffler of claim 12, wherein one of the intermediate sections has a diameter small than a diameter of the inlet pipes.

14. The muffler of claim 10, wherein a diameter of each of the two outlet pipes is substantially equally to a diameter of each of the two inlet pipes.

15. The muffler of claim 1, wherein the at least one aperture in the outlet pipe is separated from the merge exit by a distance at least equal to or greater than one half the diameter of the inlet end of the outlet pipe.

16. A performance-enhancing muffler for internal combustion engines, comprising:

an enclosed case having an inside;

two inlet pipes located inside the case comprising:

respective inlet ends extending through a frontside of the case and adapted for connection with two outside engine manifold exhaust pipes; and respective interior ends opposite the inlet ends merging together to define a merge entry;

an outlet pipe located inside the case comprising:

an outlet end extending through a backside of the case and adapted for connection with an outside tailpipe;

an interior end opposite the outlet end defining a merge zone exit; and a plurality of apertures in the outlet pipe communicating with the inside of the case; and a piping merge zone between the merge entry and the merge exit for combining exhaust flows from the engine manifold exhaust pipes, wherein the two inlet pipes and the piping merge zone are without communication with the inside of the ease.

17. The performance-enhancing muffler of claim 16, wherein the outlet pipe has an internal diameter at least equal to or greater than about 1.2 times the internal diameter of an inlet pipe.

18. A method of attenuating acoustic noise in an exhaust flow, comprising:

directing a pair of exhaust flows through an exhaust piping assembly inside an enclosed muffler ease, the exhaust piping assembly having dual inlet pipes with inlet ends extending through a frontside of the case and adapted for connection with two outside engine manifold exhaust pipes, and interior ends merging together to define a merge entry;

commingling the exhaust flows during passage through a merge zone between the merge entry and a merge exit;

isolating the exhaust flows from the inside of the ease during passage through the inlet pipes and the merge zone; and communicating the exhaust flows with the inside of the case during passage through at least one outlet pipe having an interior end defining the merge exit and an outlet end extending through a backside of the case and adapted for connection with an outside tailpipe.

19. The method of claim 18, further comprising communicating the exhaust flows with the inside of the case through at least one aperture in the outlet pipe between the merge exit and the backside of the case.

20. A method of making a performance-enhancing muffler for internal combustion engines, comprising:

assembling an exhaust piping assembly comprising:

dual inlet pipes having inlet ends adapted for connection with two outside engine manifold exhaust pipes and interior ends opposite the inlet ends merging together to define a merge entry;

an outlet pipe having an outlet end adapted for connection with an outside tailpipe, an interior end opposite the outlet end defining a merge exit, and at least one aperture communicating with an outside of the outlet pipe;

a piping merge zone between the merge entry and the merge exit for commingling exhaust flows from the two engine manifold exhaust pipes; and installing the exhaust piping assembly into an enclosed case with the inlet pipes extending through a frontside of the case and the outlet pipe extending through a backside of the case, wherein the two inlet pipes and the piping merge zone are without communication with the inside of the case and the outlet pipe is in communication with the inside of the case through the at least one aperture.

21. The method of claim 20, wherein the at least one aperture in the outlet further comprises a plurality of radial openings through a sidewall of the outlet pipe.

22. The method of claim 20, wherein the at least one aperture in the outlet further comprises an annular opening between a plurality of substantially coaxial intermediate sections of the outlet pipe having different diameters.

23. The method of claim 20, wherein the at least one aperture in the outlet pipe further comprises an opening formed by a break in the outlet pipe operable to separate the outlet pipe into the outlet end and the interior end.

* * * * *